US007814843B2

(12) United States Patent
Chen et al.

(10) Patent No.: US 7,814,843 B2
(45) Date of Patent: Oct. 19, 2010

(54) FOLD DOWN WORK SURFACE FOR MOUNTING ON A WALL

(75) Inventors: George Chen, Long Grove, IL (US); Shelley Nehrt, Barrington, IL (US); Dave Story, Bartlett, IL (US)

(73) Assignee: Stack-On Products Co., Wauconda, IL (US)

( * ) Notice: Subject to any disclaimer, the term of this patent is extended or adjusted under 35 U.S.C. 154(b) by 303 days.

(21) Appl. No.: 12/139,618

(22) Filed: Jun. 16, 2008

(65) Prior Publication Data

US 2009/0308287 A1 Dec. 17, 2009

(51) Int. Cl.
*A47B 23/00* (2006.01)

(52) U.S. Cl. ..... 108/42; 108/134; 108/152; 248/240

(58) Field of Classification Search ..... 108/134–135, 108/160, 152, 179, 42, 128, 132; 248/240, 248/240.4, 188.6
See application file for complete search history.

(56) References Cited

U.S. PATENT DOCUMENTS

| | | | | | |
|---|---|---|---|---|---|
| 0,624,115 | A | | 5/1899 | Steele | |
| 1,842,954 | A | * | 1/1932 | Anderson | 248/240 |
| 1,984,602 | A | * | 12/1934 | Snyder | 248/240.3 |
| 2,001,364 | A | * | 5/1935 | Larsson | 108/134 |
| 2,636,549 | A | | 4/1953 | Geller | |
| 2,716,044 | A | * | 8/1955 | Overby | 108/166 |
| 2,843,436 | A | | 7/1958 | Franks | |
| 2,943,896 | A | * | 7/1960 | Gaston | 108/134 |
| 3,026,158 | A | * | 3/1962 | Freeman | 108/10 |
| 3,113,533 | A | * | 12/1963 | Snow | 108/134 |
| 3,357,729 | A | * | 12/1967 | Krueger | 403/85 |
| 4,100,858 | A | | 7/1978 | Bue et al. | |
| 4,313,385 | A | | 2/1982 | Fitzgerald | |
| 4,632,457 | A | * | 12/1986 | Hofrichter et al. | 297/335 |
| 4,998,484 | A | | 3/1991 | Groetzinger | |
| 5,381,738 | A | | 1/1995 | Meyer | |
| 5,636,404 | A | | 6/1997 | Ribera | |
| 5,713,404 | A | | 2/1998 | Ladewig | |
| 6,089,651 | A | | 7/2000 | Carmen | |
| 6,343,834 | B1 | * | 2/2002 | Wurmlinger | 297/14 |
| 7,168,372 | B2 | | 1/2007 | Fotia | |

(Continued)

FOREIGN PATENT DOCUMENTS

| | | |
|---|---|---|
| CA | 2492948 | 7/2006 |

(Continued)

*Primary Examiner*—Hanh V Tran
(74) *Attorney, Agent, or Firm*—Seyfarth Shaw LLP

(57) ABSTRACT

A folding work surface for mounting on a wall. The work surface includes a platform hinged to the wall. A pair of upper supports are pivotally connected to the platform and pivotally connected to a lower support. The lower support is then pivotally connected to the wall. A locking ring is positioned on each of the upper supports. A stop bracket is also included and has a base secured to the lower support and has a pair of locking tabs separately extending outwardly which extend along a portion of the upper supports. When the platform is in an opened position, the upper supports and the lower supports aligned to permit the locking rings to slide over the locking tabs securing the locking tabs against the upper supports and thereby locking the platform in the opened position.

11 Claims, 8 Drawing Sheets

U.S. PATENT DOCUMENTS

| | | | | |
|---|---|---|---|---|
| 7,210,414 | B1 * | 5/2007 | Barone | 108/42 |
| 7,258,197 | B1 | 8/2007 | Wicks | |
| 7,278,229 | B1 | 10/2007 | Fen | |
| 7,293,813 | B2 | 11/2007 | Squyres et al. | |
| 7,309,202 | B1 | 12/2007 | Anderson | |
| 7,310,899 | B1 | 12/2007 | Costa et al. | |
| 7,350,549 | B2 | 4/2008 | Carter | |
| 7,367,616 | B2 | 5/2008 | Summerford | |
| 7,370,899 | B2 | 5/2008 | Powers, Jr. et al. | |
| 2004/0255829 | A1 * | 12/2004 | Cizmar et al. | 108/132 |
| 2006/0011106 | A1 * | 1/2006 | Hauck | 108/36 |
| 2006/0137578 | A1 | 6/2006 | Noding | |
| 2006/0162623 | A1 | 7/2006 | Ciulla | |
| 2008/0017082 | A1 | 1/2008 | Bue | |
| 2008/0030002 | A1 | 2/2008 | Jakins et al. | |
| 2008/0092784 | A1 | 4/2008 | Merensky | |

FOREIGN PATENT DOCUMENTS

| | | | | |
|---|---|---|---|---|
| DE | 3916347 | * | 8/1990 | 108/134 |
| GB | 2203638 | * | 10/1988 | 108/160 |
| WO | 8802430 | * | 4/1988 | 108/134 |

* cited by examiner

FOLD DOWN WORK SURFACE FOR MOUNTING ON A WALL

FIELD OF THE INVENTION

The present invention relates to a tables and work surfaces that mount to a wall and that may be folded down for convenient storage and for saving space.

BACKGROUND OF THE INVENTION

Folding tables are convenient for supporting things when needed and compacting for occupying a smaller space when not in use. There are numerous types of folding tables in the prior art each of which may hold distinct advantages over other types of designs. However, there is a continual need to develop new and improved designs.

SUMMARY OF THE INVENTION

In accordance with an embodiment of the present invention, a folding work surface for mounting on a wall is provided to include a platform; at least one hinge, having a first section mounted to a bottom surface of the platform and having a second section hingedly connected to the first section and mounted to the wall; a pair of upper supports, each having an first end separately secured by a pivot bracket to the bottom surface of the platform, each upper support further having a second end; a lower support having a first end secured by a pivot bracket to the wall and having a second end, and wherein the second end of each of the upper supports is pivotally secured to a side region of the second end of the lower support; a pair of locking rings separately positioned on each of the upper supports, each of the locking rings having an opening defined to permit the locking rings to slide over the upper supports; and a stop bracket having a base secured to the second end of the of the lower support and having a pair of locking tabs separately extending outwardly from sides of the base to extend along a portion of the second end of the upper supports, wherein when the platform is in a substantially horizontal position defining an opened position, the upper supports and the lower supports are aligned to permit the pair of locking rings to slide over the locking tabs securing the locking tabs against the upper supports thereby locking the platform in the opened position.

In another aspect of the embodiment, a closed position if defined when the locking rings are slid away from the locking tabs, such that the upper supports and the lower supports are movable towards the wall allowing the platform to move to a substantially vertical position that hides the upper and lower supports.

In another aspect of the embodiment the second section of the hinge further includes a first portion that secures to the wall and a second portion that is angled away from the first portion and that is hingedly connected to the first section of the hinge at an end distal to the first portion, wherein when the work surface is in the closed position, the bottom surface of the platform is positioned a distance from the wall defined by the length of the second portion of the second section of the hinge.

In yet another aspect of the embodiment, each of the upper supports includes a middle section which curves at an angle in opposite directions at its distal ends to form the first and second ends. The angle of curvature defined at the ends of the upper support may be between 120 and 130 degrees.

In yet still another aspect of the embodiment, the stop bracket further includes a flange angled from the base and positioned to rest against an edge defined by the first end of the lower support.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DESCRIPTION OF THE EMBODIMENTS

Figure 1:
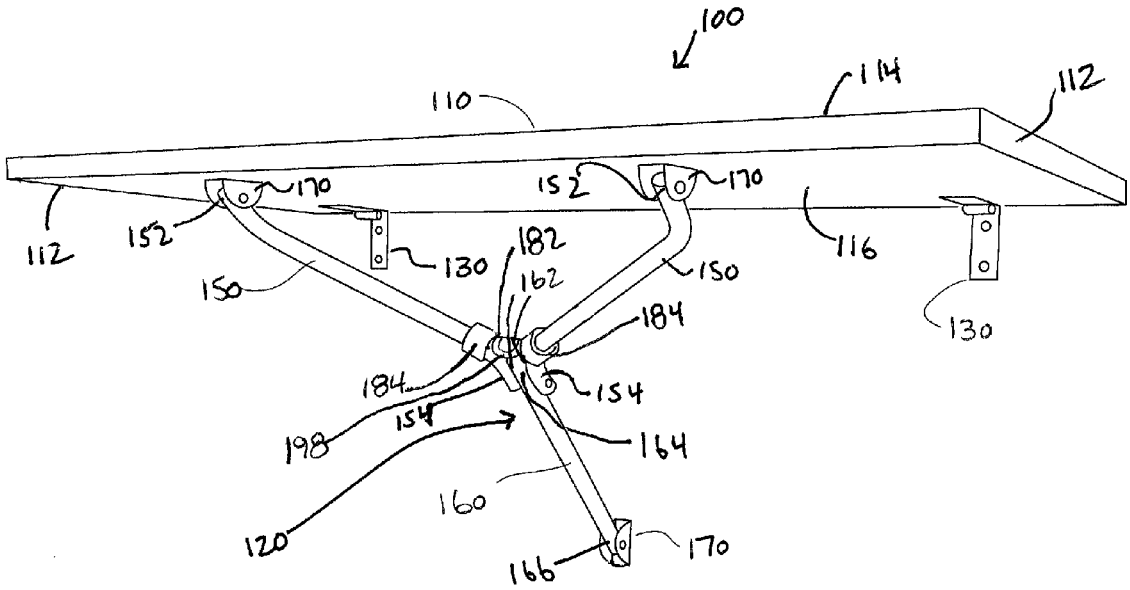
FIG. 1 is a front perspective view of a fold down work surface in accordance to an embodiment of the invention, illustrating an opened position.
Figure 2A:
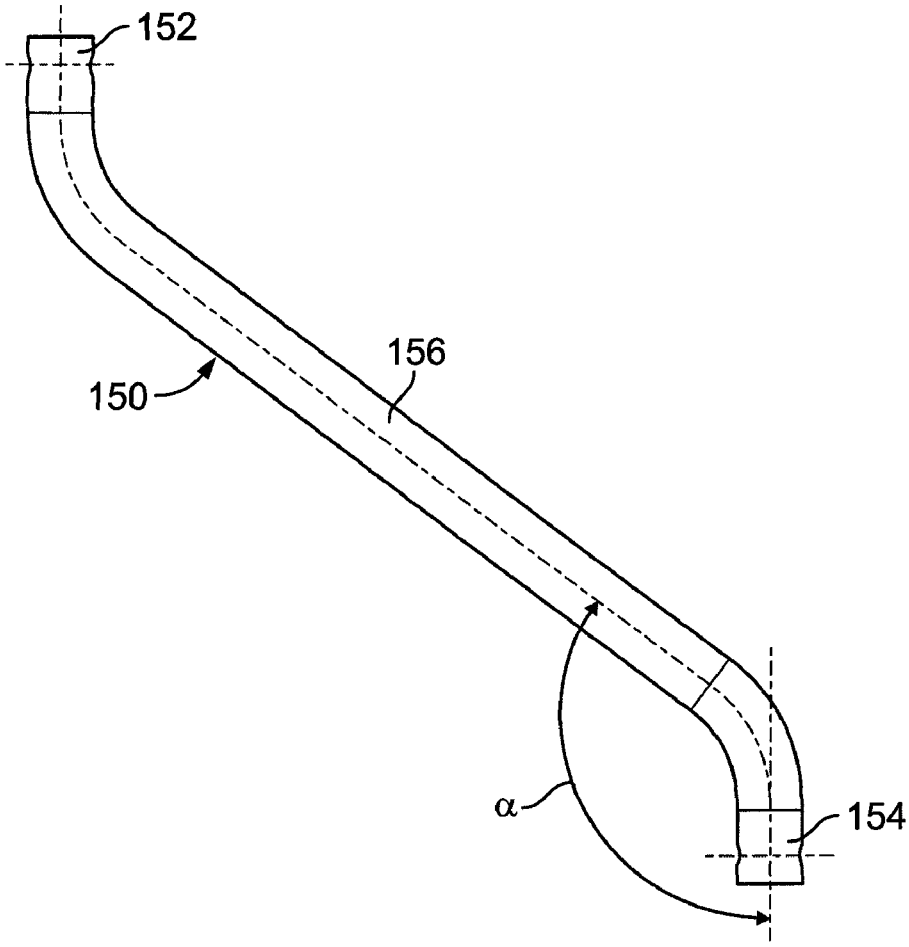
FIG. 2*a* is a side view of an upper support used in an embodiment of the invention.
Figure 2B:
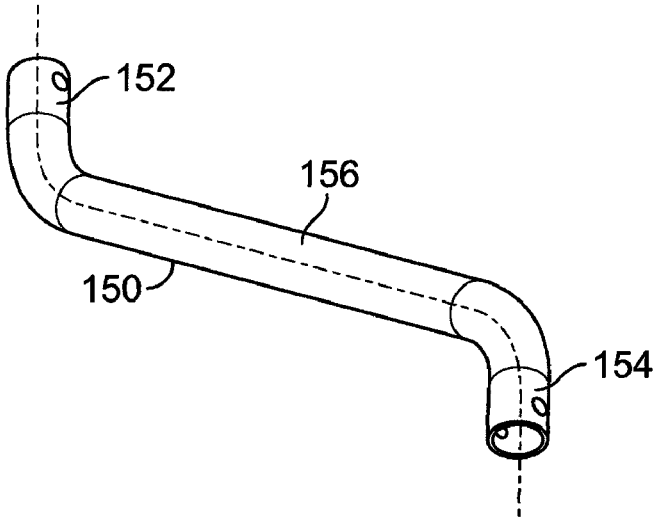
FIG. 2*b* is a perspective view of FIG. 2*a;*
Figure 3A:
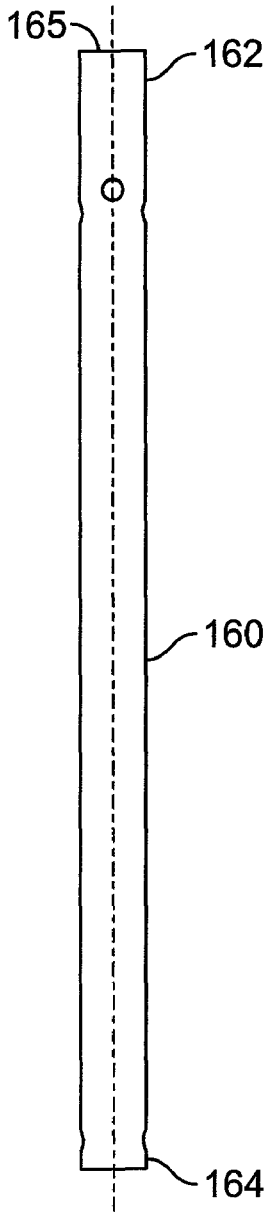
FIG. 3*a* is a side view of a lower support used in an embodiment of the invention.
Figure 3B:
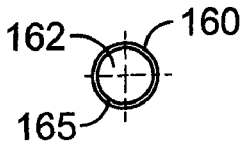
FIG. 3*b* is an end view of the lower support from FIG. 3*a;*
Figure 4A:
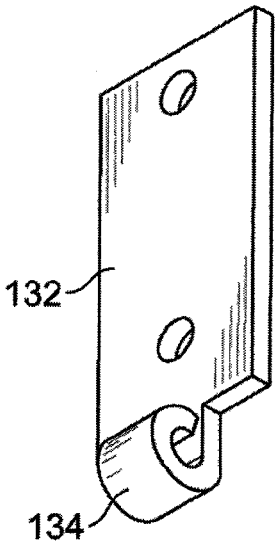
FIG. 4*a* is a perspective view of a first section of a two-sectioned hinged used in an embodiment of the invention.
Figure 4B:
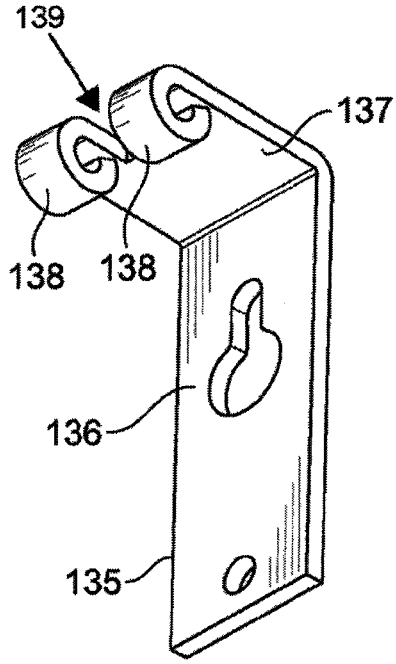
FIG. 4*b* is a perspective view of a second section of the two-sectioned hinged.
Figure 5:
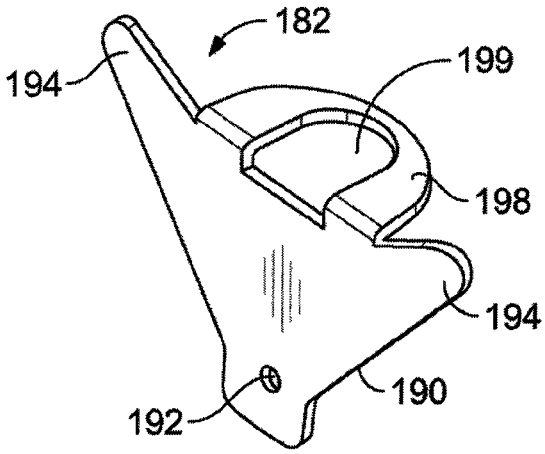
FIG. 5 is a perspective view of a stop bracket used in combination with other components in a means to lock the fold down work surface in an opened position and in accordance with an embodiment of the invention.
Figure 6:
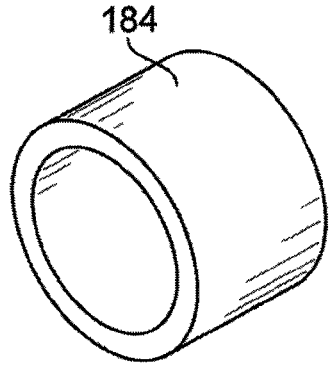
FIG. 6 is a locking ring used with the stop bracket to lock the fold down work surface in the opened position.
Figure 7C:
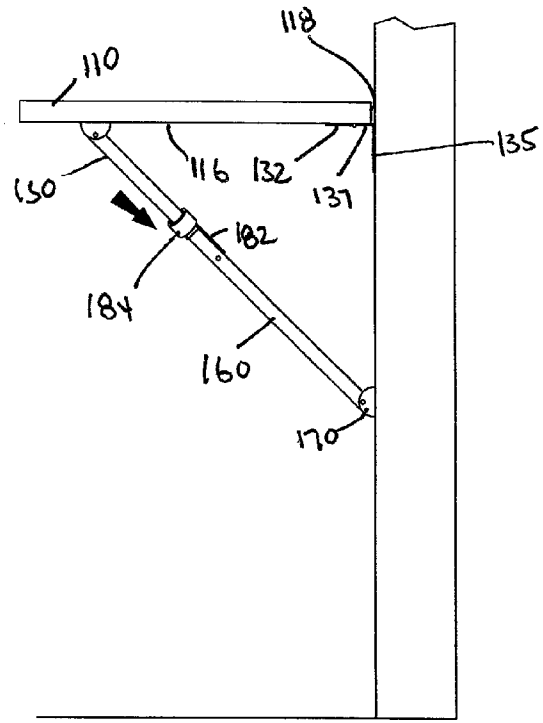
FIGS. 7*a*-7*d* are views showing a fold down work surface being moved from a closed position to the opened position.
Figure 7B:
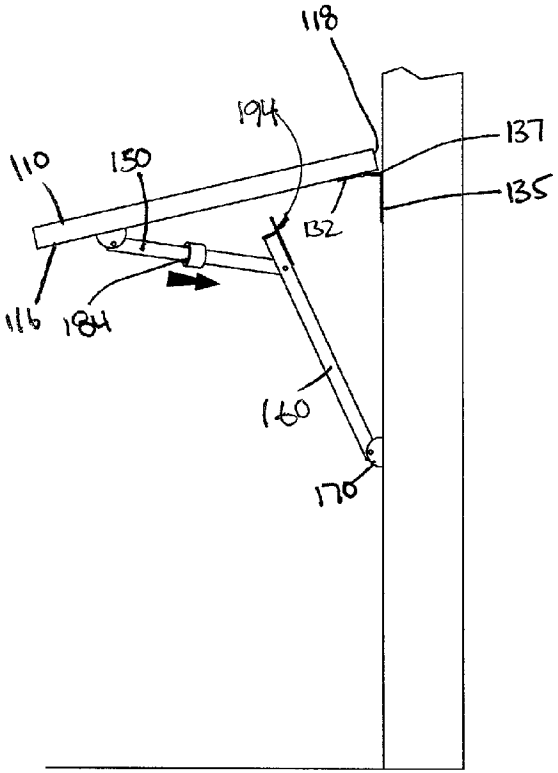
Figure 7A:
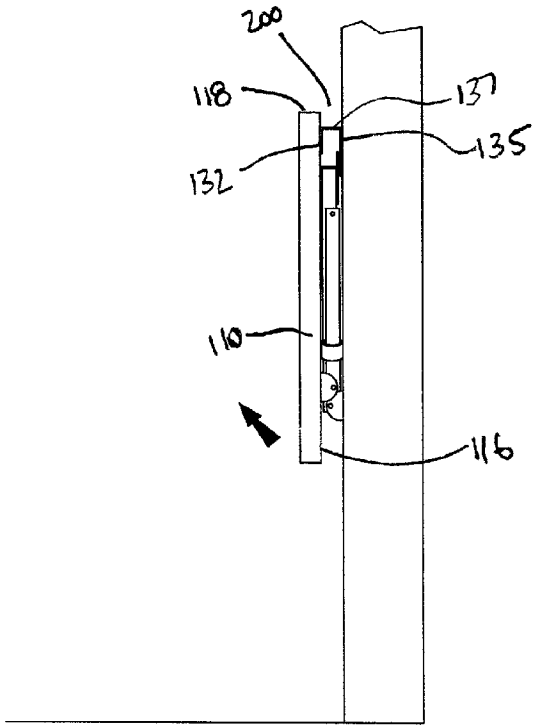
Figure 7D:
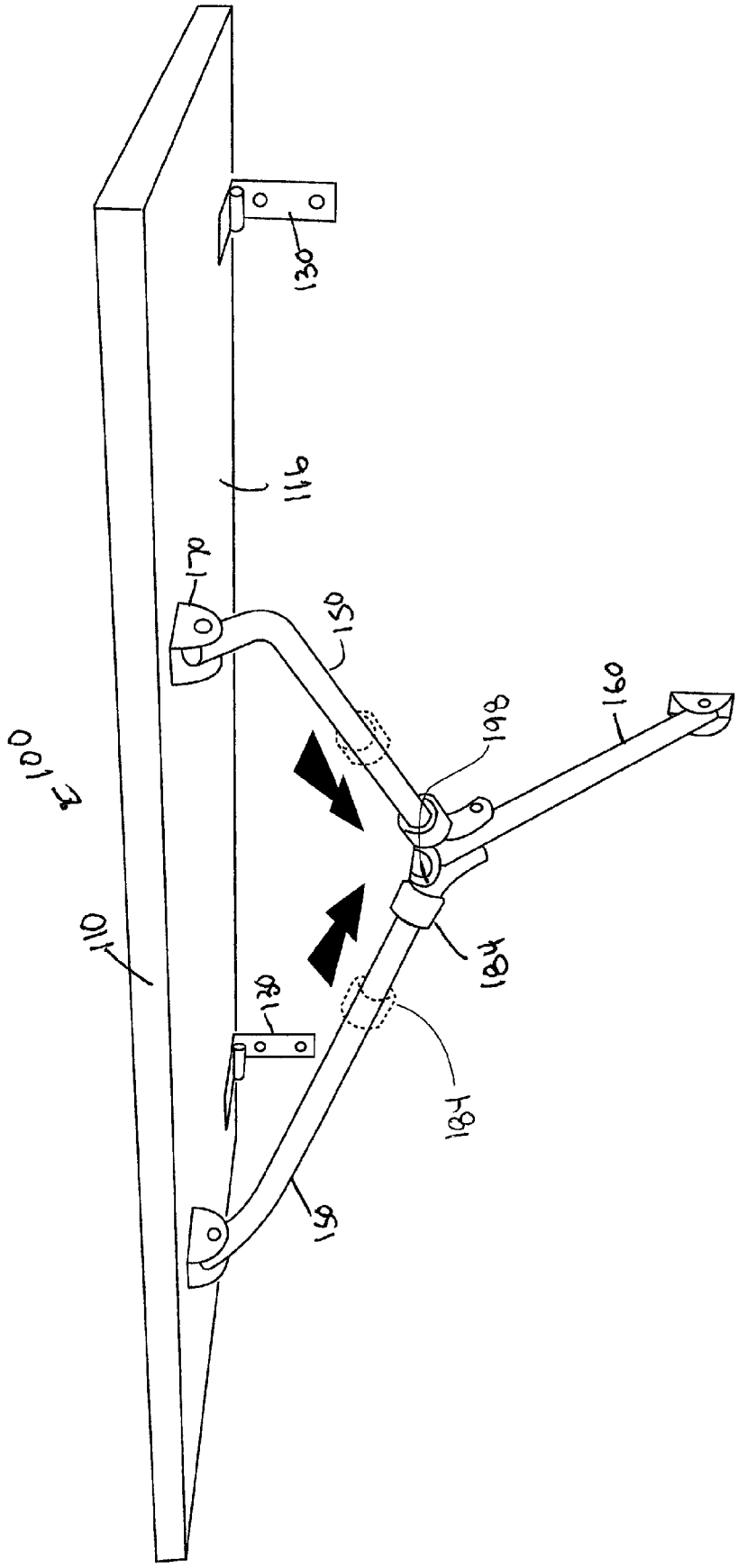

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims by the embodiments illustrated.

Referring now to FIG. 1, there is shown generally a fold down work surface 100 held in an upright and locked position. The fold down work surface 100 comprises a work surface assembly of components that include a platform 110 a support assembly 120 and at least one hinge 130 that secures the platform 110 to a wall or other vertical surface. In the embodiment illustrated, the work surface assembly includes a pair of hinges 130 separately positioned about ends 112 of the platform 110.

The platform 110 has a top surface 114 and a bottom surface 116. The bottom surface 116 is used for the connection of the at least one hinge 130. The platform may be made of any material and sized appropriately for any particular purpose.

The support assembly 120 includes a pair of upper supports 150 that are joined to a lower support 160. The first ends 152 of the upper supports 150 are attached to the bottom surface 116 of the platform 110 by pivot brackets 170. The second ends 154 of the upper supports 150 are attached to the sides 162 of a first end 164 of the lower support 160. The second end 166 of the lower support 160 is lastly attached to the wall or vertical surface by a pivot bracket 170.

As further described below, the junctions of the upper supports 150 to the lower support 160 includes a means for locking 180 the supports in position. The locking means 180 includes a stop bracket 182 and a pair of locking rings 184.

Referring now to FIGS. 2*a*-6, the individual components will be more fully described where necessary. The upper supports 150 include a middle section 156 which curves towards its ends to form the first end 152 and to form the second end 154. The angle of curvature a is preferably about 115 to 140 degrees, but may be further defined at about 120 to 130 degrees, at in one embodiment was positioned at about 126 degrees. The lower support 160 may simply be a substantially straight support without any need for curved sections.

The hinges 130 may be defined into a two sectioned hinge. The first section 132 secures directly to the bottom surface 116 of the platform 110 and includes at least one fastening hole and a curved portion 134 defined at one end. The second section 135 of the two sectioned hinge includes a first portion 136 that secures to the wall by at least one fastening hole. The second section 135 further includes a second portion 137 that is angled away from the first portion 136. The second portion 137 includes a pair of curved portions 138 separated by a space 139 sized to receive the curved portion 134 defined at the end of the first section 132. All of the curved portions 138 and 134 are aligned during assembly as secured in place by a pin that permits the two sectioned hinge to pivot such that the platform 110 may move to and from the closed and opened position.

As mentioned above, the locking means 180 includes a stop bracket 182 secured to the first end 162 of lower support 160 substantially adjacent to the region where the upper supports 150 attach to the lower support 160. The stop bracket 182 includes a base 190 with an aperture 192 for attaching the stop bracket 182 to the first end 162 of the lower support 160. Any type of fastener can be used to secure the stop bracket 182 against the lower support 160. A pair of locking tabs 194 extend outwardly in the form of wings from the base 190. Positioned between the locking tabs 194 near a top portion 196 of the base 190 is a flange 198. The flange 198 extends outwardly from the top portion 196 and is designed to be positioned against an edge 165 defined at the first end 162 of the lower support 160. The flange 198 may be U shaped and define an opening 199 between the closed section of the U-shape and the top portion 196 of the base.

During assembly, the hinges 130 and the brackets 170 are secured to the wall and the bottom surface 116 of the platform 110. The upper supports 150 and the lower support 160 are then secured to the brackets and the locking rings 184 are positioned onto the upper supports 150 prior to securing the ends of the upper supports 150 to the lower support 160. The stop bracket 184 can then be secured to the lower support 160. The manner in which the fold down work surface is assembled may change without changes the scope and spirit of the invention.

Figure 8C:
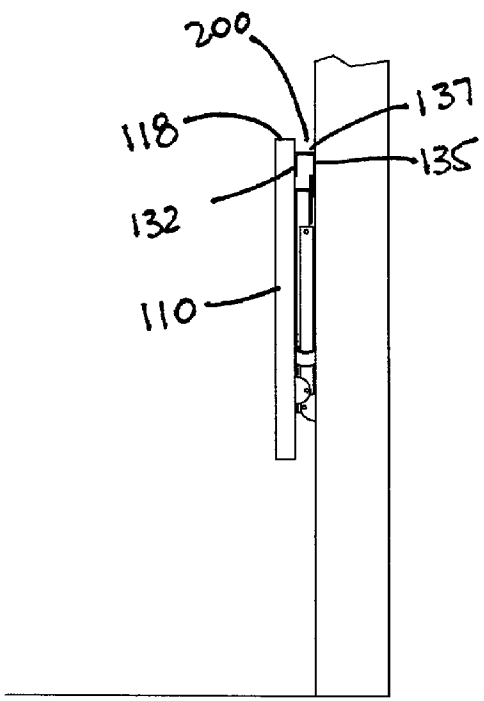
FIGS. 8*a*-8*d* are views showing a fold down work surface being moved from an opened position to the closed position.
Figure 8B:
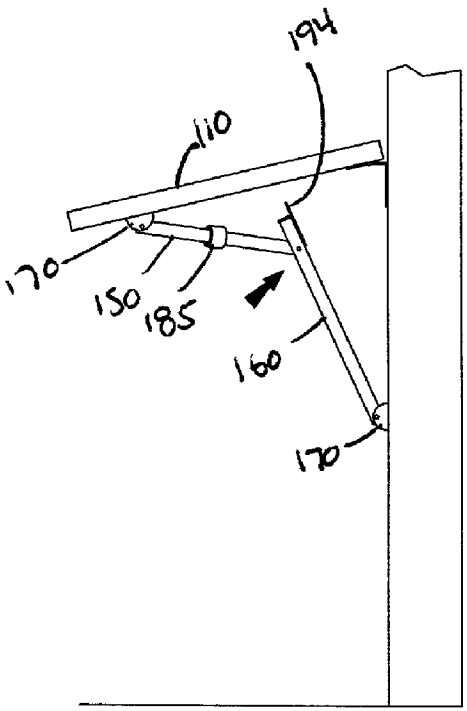
Figure 8A:
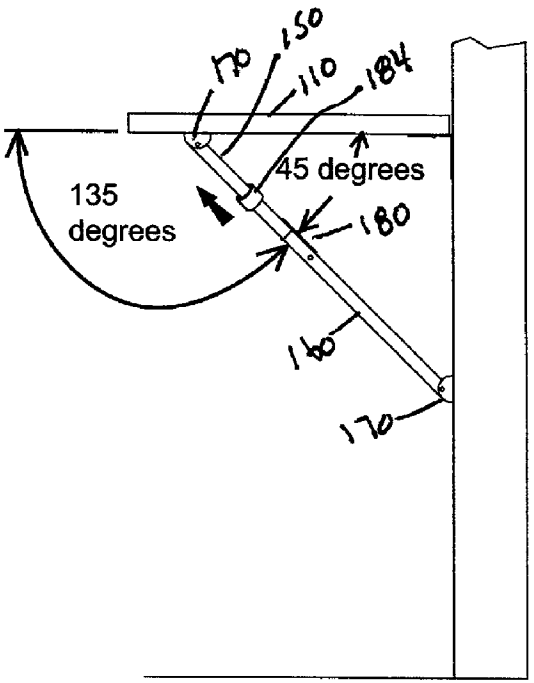
Figure 8D:
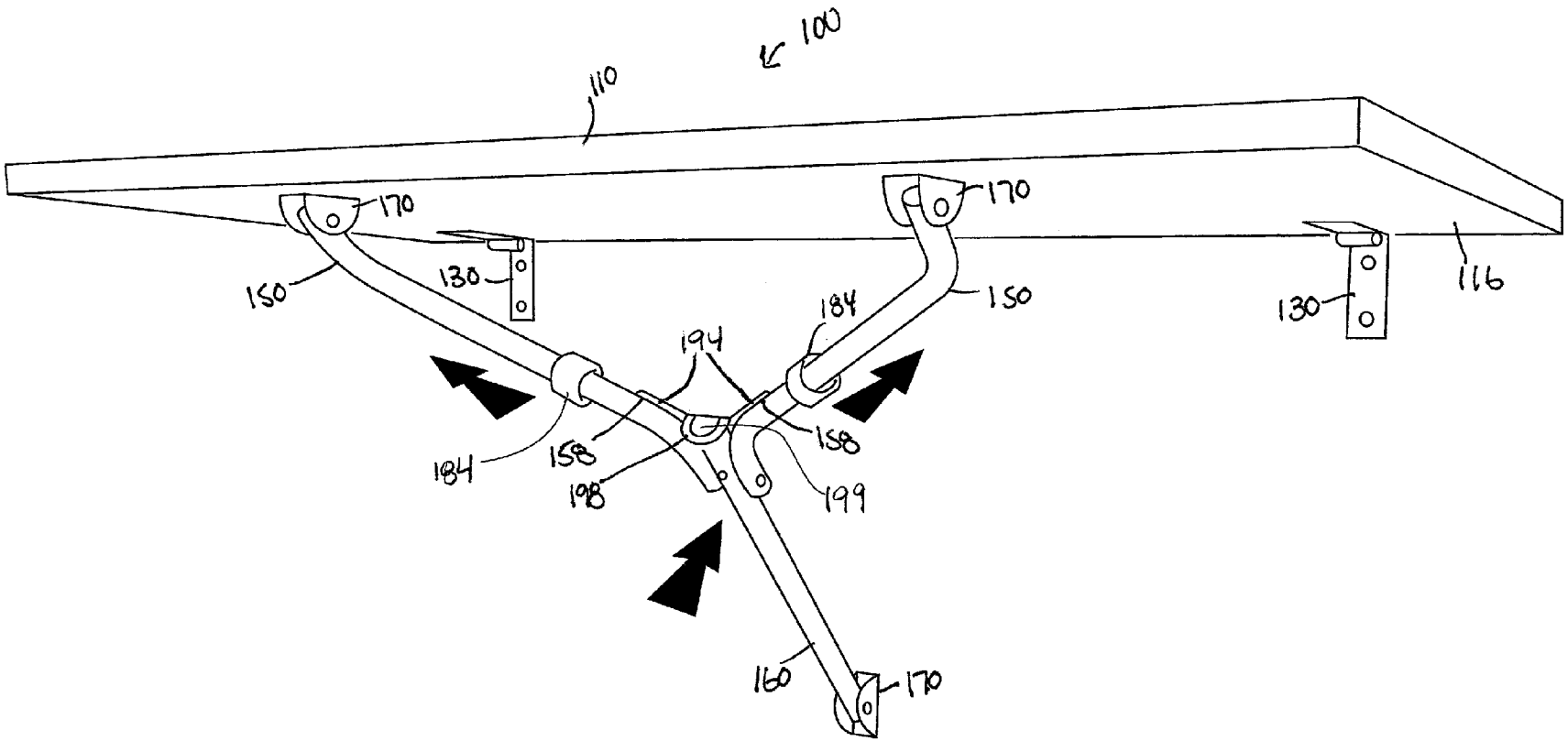

Referring now to FIGS. 7-8*d*, once the fold down work surface is assembled, the work surface may be moved to the closed or opened position. As illustrated in FIG. 7*a*, from the closed position, the two sectioned hinge 130 positions the platform 110 away from the wall such that the upper and lower supports can fold and hide nicely between the platform and the wall. In addition, the two sectioned hinge 130 having the second portion 137 defined on the second section 135 that is angled away from the first portion 136 defined a gap 200 between the bottom surface 116 and the wall such that when the platform is moved to the opened position (FIGS. 7*b* and 7*c*), the rear end 118 of the platform 110 can move to become nearly adjacent against the wall.

In addition, it is understood that the placement of the hinge 130 can be made such that the rear end 118 comes into contact with the wall when the platform is moved to the opened position. The gap 200 is defined by a length of the second portion 137 of the second section 135 of the hinge. While the length may be predetermined to define a specific distance, in different embodiments the length of the gap varied from about ¼ to about 1 inch.

In addition, when the fold down work surface 100 is moved to the opened position, the locking tabs 194 on the stop bracket 182 will come into contact with regions 158 defined on the upper supports 150 (best illustrated in FIG. 8*d*). As the fold down work surface is being moved, gravity will cause the locking rings 184 to move downwardly towards the lower support 160 (FIG. 7*b*) and will slip over the locking tabs 194 (FIG. 7*c* and 7*d*) thereby locking the fold down word surface into place.

In order to move the fold down work surface to the closed position (FIGS. 8*a*-8*c*), the locking rings 184 are moved upwardly and a force is applied to the first end of the lower support near the region where the upper supports are attached to the lower support. At this point the platform 110 can be easily moved to the closed position.

As further illustrated in FIG. 8*a*, in the opened position the fold down work surface may be assembled such that the angle between the platform and the upper supports as between 40-50 degrees, and more preferably about 45 degrees.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is intended to cover by the appended claims all such modifications as fall within the scope of the claims.

We claim:

1. A folding work surface for mounting on a wall, the work surface comprising:

a platform;

at least one hinge, having a first section mounted to a bottom surface of the platform and having a second section hingedly connected to the first section and adapted to be mounted to the wall;

a pair of upper supports, each having a first end separately secured by a pivot bracket to the bottom surface of the platform, each upper support further having a second end;

a lower support having a first end adapted to be secured by a pivot bracket to the wall and having a second end, and wherein the second end of each of the upper supports is pivotally secured to a side region of the second end of the lower support;

a pair of locking rings separately positioned on each of the upper supports, each of the locking rings having an opening defined to permit the locking rings to slide over the upper supports; and a stop bracket having a base secured to the second end of the of the lower support and having a pair of locking tabs separately extending outwardly from sides of the base to extend along a portion of the second end of the upper supports, wherein when the platform is in a substantially horizontal position defining an opened position, the upper supports and the lower supports are aligned to permit the pair of locking rings to slide over the locking tabs securing the locking tabs against the upper supports thereby locking the platform in the opened position.

2. The work surface of claim 1, wherein when the locking rings are slid away from the locking tabs, the upper supports and the lower supports are movable towards the wall such that the platform can move to a substantially vertical position defining a closed position that hides the upper and lower supports.

3. The work surface of claim 2, wherein the second section of the hinge further includes a first portion that securable to the wall and a second portion that is angled away from the first portion and that is hingedly connected to the first section of the hinge at an end distal to the first portion, wherein when the work surface is in the closed position, the bottom surface of the platform is positioned a distance from the wall defined by the length of the second portion of the second section of the hinge.

4. The work surface of claim 3, wherein each of the upper supports includes a middle section which curves at an angle in opposite directions at its distal ends to form the first and second ends.

5. The work surface of claim 4, wherein the angle of curvature defined at the ends of the upper support is preferably between 120 and 130 degrees.

6. The work surface of claim 1, wherein the stop bracket further includes a flange angled from the base and positioned to rest against an edge defined by the first end of the lower support.

7. A folding work surface for mounting on a wall, the work surface comprising:

a platform;

at least one hinge connected to a bottom surface of the platform and adapted to be connected to the wall, such that the platform is hingedly connected to the wall;

a pair of upper supports, each having a first end separately secured by a pivot bracket to the bottom surface of the platform, each upper support further having a second end, and wherein each of the upper supports includes a middle section which curves at an angle in opposite directions at its distal ends to form the first and second ends;

a lower support having a first end adapted to be secured by a pivot bracket to the wall and having a second end, and wherein the second end of each of the upper supports is pivotally secured to a side region of the second end of the lower support;

a pair of locking rings separately positioned on each of the upper supports, each of the locking rings having an opening defined to permit the locking rings to slide over the upper supports; and a stop bracket having a base secured to the second end of the of the lower support and having a pair of locking tabs separately extending outwardly from sides of the base to extend along a portion of the second end of the upper supports, wherein when the platform is in a substantially horizontal position defining an opened position, the upper supports and the lower supports are aligned to permit the pair of locking rings to slide over the locking tabs securing the locking tabs against the upper supports thereby locking the platform in the opened position.

8. The work surface of claim 7, wherein when the locking rings are slid away from the locking tabs, the upper supports and the lower supports are movable towards the wall such that the platform can move to a substantially vertical position defining a closed position that hides the upper and lower supports.

9. The work surface of claim 7, wherein the at least one hinge is further defined as having:

a first section mounted to the bottom surface of the platform, and a second section hingedly connected to the first section and adapted to be mounted to the wall, the second section further including a first portion that securable to the wall and a second portion that is angled away from the first portion and that is hingedly connected to the first section of the hinge at an end distal to the first portion, wherein when the work surface is in the closed position, the bottom surface of the platform is positioned a distance from the wall defined by the length of the second portion of the second section of the hinge.

10. The work surface of claim 7, wherein the angle of curvature defined at the ends of the upper support is preferably between 120 and 130 degrees.

11. The work surface of claim 7, wherein the stop bracket further includes a flange angled from the base and positioned to rest against an edge defined by the first end of the lower support.

* * * * *